United States Patent [19]

Eichenlaub, Jr.

[11] 4,149,398

[45] Apr. 17, 1979

[54] SINGLE GROOVE DRAWING BLOCK ASSEMBLY

[75] Inventor: Edward B. Eichenlaub, Jr., Stow, Ohio

[73] Assignee: Wean United, Inc., Pittsburgh, Pa.

[21] Appl. No.: 834,018

[22] Filed: Sep. 16, 1977

[51] Int. Cl.[2] ..... B21C 1/14

[52] U.S. Cl. ..... 72/289

[58] Field of Search ..... 72/280, 287, 289; 242/47.08, 47.09, 47.11, 78, 117, 82, 83

[56] References Cited

U.S. PATENT DOCUMENTS

| | | | |
|---|---|---|---|
| 1,918,237 | 7/1933 | Alden | 72/280 |
| 2,179,348 | 11/1939 | Penney | 72/280 |
| 2,943,810 | 7/1960 | Seavey | 242/83 |
| 3,106,354 | 10/1963 | Kitselman | 242/47.08 |
| 3,270,979 | 9/1966 | Whitacre | 242/82 |
| 3,331,566 | 7/1967 | Kitselman | 242/83 |
| 3,881,340 | 5/1975 | Hay | 72/289 |

*Primary Examiner*—Michael J. Keenan

*Attorney, Agent, or Firm*—Daniel Patch; Suzanne Kikel

[57] ABSTRACT

A rotating block assembly used with a die for drawing thin walled metallic tubing in which the block has a continuous single groove for receiving and tensioning the tubing between the block and die. The contour of the groove is formed by two identical opposite surfaces generated on a continuous radius having a separating angle between the cooperative surfaces ranging from 17° to 22°.

4 Claims, 3 Drawing Figures

SINGLE GROOVE DRAWING BLOCK ASSEMBLY

In the past it has generally been the practice for cold drawing metallic tubing such as copper tubing to create the required tension on the tubing by passing one or more overlapping convolutions of the tubing around a rotating straight-faced block arranged down stream from the die assembly. Aside from the influence this procedure had on the design of the block and power requirements, in order to draw thin walled tubing much difficulty was experienced in preventing the tubing from becoming oval. This objectionable ovality, particularly in copper tube ranging from ⅛" O.D. to 5/16" O.D. with thicknesses on the order of 0.012" to 0.010" was due mainly from the required tension and diameter of the block and the overlapping process of creating the tension. A prior patent illustrating this general procedure is found in U.S. Pat. No. 3,496,751, dated Feb. 24, 1970.

In recognition of this problem it has been suggested to employ a single groove block in combination, in certain instances, with a pressure roller designed to hold the tubing in the groove. One such approach is disclosed in U.S. Pat. No. 3,881,340 dated May 6, 1975. Other patents known to the applicant pertaining to metallic filament drawing that employed single grooved blocks are U.S. Pat. No. 3,106,354 dated Oct. 8, 1963; U.S. Pat. No. 3,235,202 dated Feb. 15, 1966; U.S. Pat. No. 3,270,979 dated Sept. 6, 1966; and U.S. Pat. No. 3,331,566 dated July 18, 1967.

To the best of the applicant's knowledge the single groove block has not enjoyed success in the tube drawing industry on a wide commercial basis because of the inability to handle a reasonable range of sizes without requiring the changing of the block and more particularly, the groove and the tendency for the tubing to not readily free itself from the groove as it leaves the block.

Past grooves, formed as illustrated in several of the aforesaid patents had straight sides, i.e., the grooves took the form of a straight or flat sided "V". Such "V" grooves, if the proper angle was selected for a particular O.D. tubing, contributed to avoiding ovality. However, considering from a practical matter the many variables normally involved, such as type of material, material hardness, difference in percentage reduction of different tubing, wall thickness, and tubing O.D., known single groove blocks were very limited in application, and required a continuous replacement of the blocks in order to cover a reasonable range of the drawing plant.

It is therefore an object of the present invention to provide a single groove tube drawing block for drawing metallic tubing which block could be rotatable or stationary, in which the groove is so formed that recognizing the above listed variables, a wide range of size tubing is capable of being handled without changing of the blocks, and wherein both ovality and sticking will be substantially reduced.

A further object of the present invention is to provide in combination with a block assembly for drawing metallic tubing through a die, the improvement comprising: a single groove for said block assembly for receiving and exerting tension on the tubing for drawing, said groove being defined from a plane perpedicular to its major axis as a continuous circular opening formed in said block assembly about said axis and from a radial section from said axis the opposite corresponding surfaces of the opening converge toward the center of the block in which the opposite corresponding surfaces are formed by continuous curves, and wherein the separating angle formed by said opposite surfaces of the opening, measured at diametrically opposite points, varying progressively from the apex to the outside terminus of the opening.

These objects, as well as other novel features and advantages of the present invention will be better understood when the following description of the preferred embodiment thereof is read along with the accompanying drawings of which:

Figure 1:
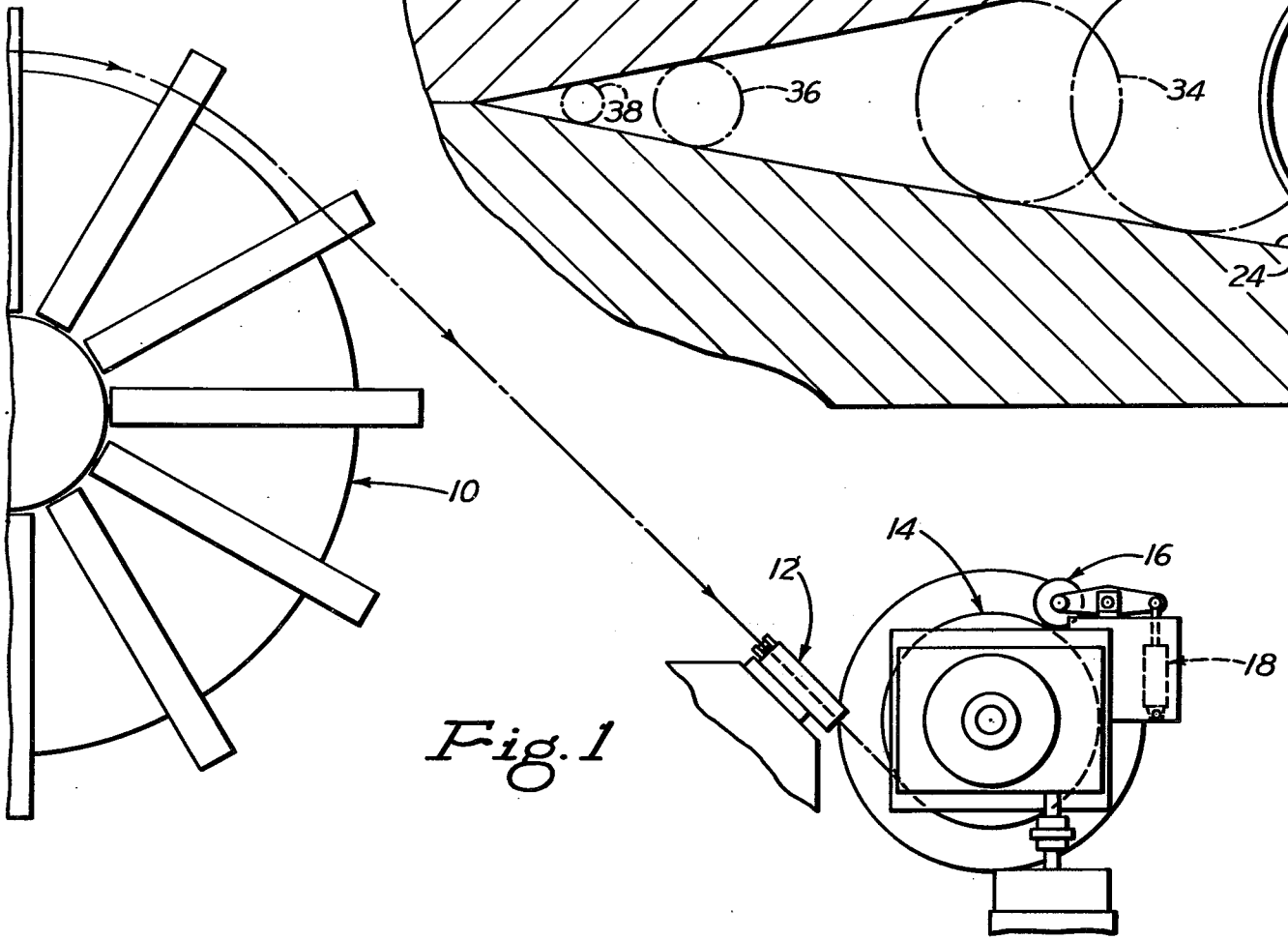
FIG. 1 is a plan view of a thin wall metallic tube drawing machine, including a rotatable block built in accordance with the teachings of the present invention.

Referring first to FIG. 1, there is illustrated the general layout of a metallic tube drawing arrangement for both thick and thin wall metallic tubing, the thin wall tubing ranging in O.D. sizes from 3/16" to 5/16" with wall thicknesses of 0.012" to 0.010", and thick wall O.D. from 0.045" to 0.090". In certain cases the tube size may be extended to 3". It will be appreciated at the outset that aside from the contour of the groove and its adjustable feature, the equipment illustrated is generally well known in the art. It consists of a pay-off table 10 on which tubing to be drawn is placed, the table allowing a bundle of tubing to be fed as indicated by the several arrows to a die assembly 12 where the tubing will be reduced when pulled through the die by the tension placed on the tubing by a rotating block assembly 14.

The block assembly 14 includes a pressure roller assembly 16 and a piston cylinder assembly 18 for urging the roller under a controlled but relatively low pressure against a single strand or length of tubing as the tubing passes around the block assembly 14. The reduced tubing after it leaves the block assembly 14, automatically falls down into an awaiting rotating basket. The described procedure is to be understood to involve a batch process in which incoming and outgoing bundles of tubing are handled.

Figure 2:
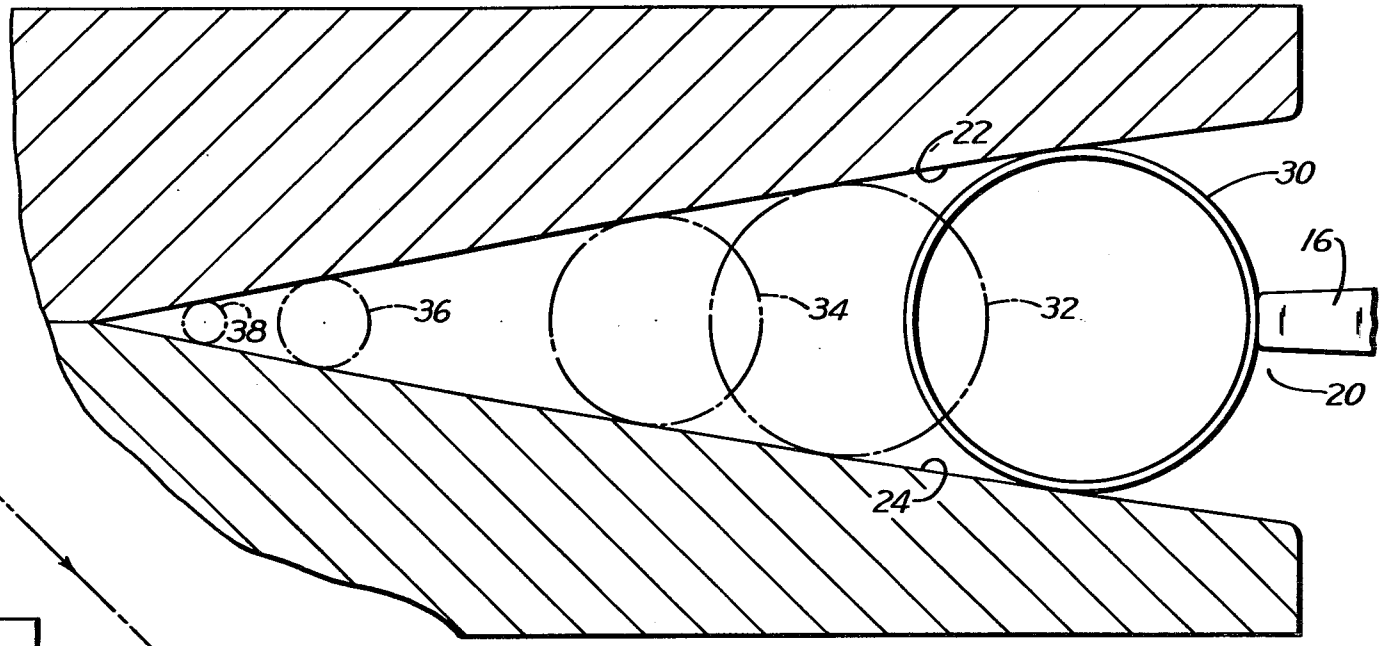
FIG. 2 is a sectional view of the single groove member shown in FIG. 1 illustrating a possible range of tube sizes capable of being handled by the illustrated groove.
Figure 3:
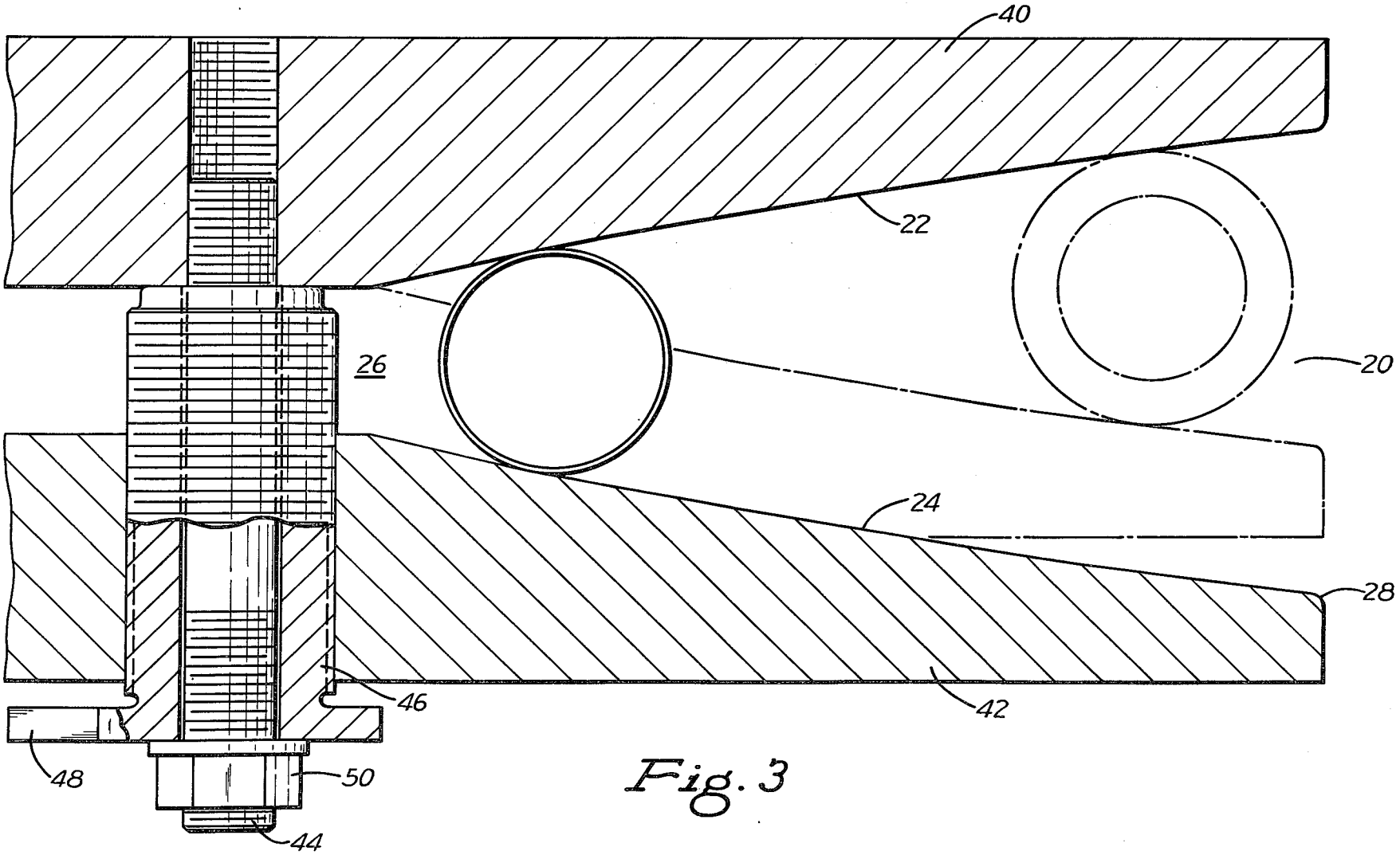
FIG. 3 is a view similar to FIG. 2 except of the adjustable feature which has been added.

In referring now to FIGS. 2 and 3 where the novel contour of the single groove or opening 20 of the block assembly is better illustrated, it will be appreciated that the contour of the walls of the groove has been exaggerated in order to better describe its characteristics. As indicated in FIGS. 2 and 3 the opposite surfaces, as viewed in radial section, of the groove 20 are formed by substantially identical radii drawn so that substantially identical continuous curved surfaces 22 and 24 are formed and opposed diametrically points correspond to the radius or slope. Moreover, the curved surfaces 22 and 24 form separating angles from the apex 26 to the termini 28 that decrease in a direction away from the apex 26 from preferably an angle of 22° to an angle of 17° for the particular range of sizes noted above, although the range may be extended to 12° and 25°.

In FIG. 2, which illustrates a fixed groove block design, a series of thin wall tubes are illustrated at 30, 32, and 34, which, because of the requirements presented in drawing thin wall tubing they are caused to be engaged in the 17° angle separating portion, the larger O.D. size 5/16" being arranged at the 17° position, while the smaller sizes are arranged progressively inwardly and at progressively increased angles, but still outward of the 22° angle position. In gripping the thin walled tubing at or near the outside or 17° position of the groove 20, there is allowed more tube support to reduce ovality. The smaller the angle of the groove, the better the tube is supported or restrained from going oval. However, the smaller the angle of the curve the greater the wedging action developed so that too small an angle can result in the tube sticking in the groove and not shedding itself from the block.

The same consideration is less important when drawing thick walled tubing which can be drawn at much higher tension than the thin wall tubing so that as shown in FIG. 2, tubes 36 and 38 which represent thick wall tubing can be arranged in the 22° zone of the groove 20. Actually the present invention provides a significant advantage by the particular formation of the continuous curved groove 20 with its progressively decreasing separating angle outward of the apex in handling both thick and thin walled tubing, since the thick wall requires less groove surface or restraining support, but permits heavier drawing tension which the larger separating angle allows.

For obtaining a maximum range for thin wall or a combination of maximum ranges for both thin and thick wall tubing thereby reducing considerably the need for many size blocks for different separating angle grooves as illustrated in FIG. 3, the separating angle of the groove 20 can be made adjustable. Also it is possible to provide the same angular groove range by using a pair of convex surfaces in counterdistinction to the concave surfaces shown in FIGS. 2 and 3. In this case the 17° angle would be formed at the inside of the groove 20 and the 22° angle would be formed at the outside of the groove. The adjustable feature is accomplished as shown in FIG. 3 by providing for the opposed surfaces 22 and 24 of the groove 20 to be formed on separate members 40 and 42 in which a threaded bolt 44, arranged inward of the apex of the groove 20 extends between the members 40 and 42. The member 42 is adjustable toward and away from the member 40 by providing an outer threaded sleeve 46 with an inward portion that abuts against the member 40 whereby on rotation of the sleeve 46 the member 42 will move toward or away from the member 40 over the outer threads of the sleeve 46. At the outer end of the bolt 44 ther is provided a pointer 48 for indicating the separating angle between the surfaces 22 and 24 as a function of the position of the sleeve 46. On the bolt 44 there is provided a nut 50 that locks the adjusting assembly from inadvertently turning once an adjustment has been affected.

In FIG. 3 since the surfaces 22 and 24 are relatively adjustable, depending on the particular variables involved in a particular drawing operation, the large angle, or 22° angle portion can be employed for reducing thin wall tubing. This again as noted before, recognizes the proper balance between the optimum restraining force provided by the surfaces 22 and 24 for preventing ovality and yet avoiding sticking of the tubing. By the same token in drawing thick walled tubing the smaller or 17° portion of the groove 20 can be employed, if desired. In this case, as shown in phantom, the surfaces 22 and 24 are brought together to accommodate a particular size thick wall tube. Thus, it can be seen that the combination of the continuous curved surface 22 and 24, in presenting a decreasing angular opening from its apex and the adjustable opening feature of the groove 20, allows the greatest possible flexibility in obtaining optimum separating angles resulting in better control of ovality and sticking in thin wall tubing and the added capacity to make heavy drafts when drawing thick wall portion.

In accordance with the provisions of the patent statutes, I have explained the principle and operation of my invention and have illustrated and described what I consider to represent the best embodiment thereof.

I claim:

1. In combination with a rotating block assembly for drawing through a die a wide range of different thickness to diameter ratio metallic tubing, the improvements comprising:

a single groove for said block assembly for receiving and exerting tension on the tubing for drawing, said groove being located in the peripheral surface of said block which is parallel to the rotational axis of said block and the groove is formed as a continuous circular opening and wherein from a radial section from said axis the opposite corresponding surfaces of the opening converge toward the center of the block into an apex in which the opposite corresponding surfaces are formed by identical but reversed continuous curves, said surfaces combining to form corresponding different separating angles from said apex to the terminus of said opening that decrease progressively in a direction away from said apex, and in which the smallest separating angle approximates 17° and the largest separating angle approximates 22°, and further wherein said surfaces defining the smallest separating angle provides means for drawing tubing of a first given ratio of thickness to outer diameter of the tubing and said surfaces defining the largest separating angle provides means for drawing a second given ratio of thickness to the outer diameter of the tubing.

2. In combination with a block assembly according to claim 1; in which said opposite corresponding surfaces are formed on separate block members, and wherein said block assembly includes means for adjusting one of said block members relative to the other block member to vary said separating angle.

3. In combination with a block assembly according to claim 2, wherein said adjusting means includes a locking means to hold said block members in an adjusted position.

4. In combination with a block assembly according to claim 2, wherein said smallest separating angle is employed to draw a lower ratio of thickness to outer diameter tubing and said largest separating angle is employed to draw a higher ratio of thickness to outer diameter tubing.

* * * * *